United States Patent [19]

Anderson

[11] Patent Number: 4,589,235

[45] Date of Patent: May 20, 1986

[54] PANEL PARTITION ARRANGEMENT FOR RECREATION CHAMBER FORMATION IN DOMESTIC GARAGES

[76] Inventor: Paul S. Anderson, 227 S. Orr Dr., Normal, Ill. 61761

[21] Appl. No.: 588,447

[22] Filed: Mar. 12, 1984

[51] Int. Cl.[4] ..... E04H 6/00; A63B 71/04

[52] U.S. Cl. ..... 52/28; 52/29; 52/36; 52/204

[58] Field of Search ..... 52/27, 71, 36, 204, 52/64, 28, 29; 272/3; 49/197, 198, 199, 200

[56] References Cited

U.S. PATENT DOCUMENTS

| | | | |
|---|---|---|---|
| 2,134,397 | 10/1938 | Clark . | |
| 2,361,899 | 10/1944 | Lichtor | 52/64 |
| 3,387,413 | 6/1968 | Huey | 52/71 |
| 3,984,449 | 10/1976 | Wahlquist | 272/3 |
| 4,037,385 | 7/1977 | Wahlquist . | |
| 4,446,660 | 5/1984 | Miller | 52/36 |

*Primary Examiner*—John E. Murtagh

*Attorney, Agent, or Firm*—McWilliams, Mann, Zummer and Sweeney

[57] ABSTRACT

A panel partition arrangement for domestic garages, for forming an alternately usable family sports center in the form of a recreation chamber within the space defined by domestic or family home garages and the like that are usually equipped with the familiar overhead type sectionalized garage door, in which the partition arrangement is mounted inside the garage to form with the door in its lowered position a recreation chamber within the garage for accommodating family oriented recreations such as playing ball type game sports and the like, with the garage door sections being faced on their inner sides to be in flush relation in the closed position thereof, and vertical walls being provided to form the side walls and inner end wall of the recreation chamber, of which the indicated vertical walls are flush surfaced, and the floor is obstruction free, for defining the recreation chamber, with the indicated vertical walls optionally being formed to define closet or other storage space that is normally closed at the flush surfacing thereof and optionally openable for tool and equipment storage purposes, with one or more of the walls being shiftably mounted for movement between its recreation chamber forming position, and an out of the position for normal garage use, and with the recreation chamber alternately receiving the family car or cars through the garage door when car parking in the garage is desired.

7 Claims, 14 Drawing Figures

92
194A
238
32
230
242
194
232
195
202
234
182
206
208
200
196
204
206
208
208
180
208B
206A
208A
208
204A
208
192
204A
206A
208
240
244
208B
204
236
208A
197
208
150
193
66
170
98
191
168
172
164
152
156
68
174
160
158
162
154
166
40
176
177
112

PANEL PARTITION ARRANGEMENT FOR RECREATION CHAMBER FORMATION IN DOMESTIC GARAGES

This invention relates to a panel partition arrangement for forming in the space sheltered in the typical family home garage a family sports center in the form of a recreation chamber that is alternately usable as a family vehicle parking area, or as a family gynmasium or recreation activity area, for playing ball games and the like, and more particularly, to a panel partition arrangement for erection in domestic garages to provide a recreation chamber that approaches or simulates the box or parallelepiped type configuration commonly employed for handball courts and the like, and in which at least one and up to four vertical walls define ball game playing surfacings, with one or more of the vertical walls being structured to serve tool and equipment storage purposes and arranged for optional use as defining the recreation chamber for family activity use in playing ball sport type games or the like, or as a family car or other vehicle parking and sheltering facility.

Most single family homes in urban and rural areas have a garage (attached or unattached) that is to shelter one or more of the family vehicles; depending on the size of the garage and type and size of vehicles, townhouses, apartment buildings, and condominium type facilities commonly have similar garage facilities that are usually unattached, and that ordinarily are available on the single or double car parking basis. Garage construction of these types in recent years commonly employ the familiar overhead sectionalized garage door to open and close the garage doorway through which the vehicles enter into and egress from the garage when the garage doorway is open.

Regardless of the specific manner in which the family garage is constructed, the space it shelters for car or other vehicle parking and equipment storage purposes is never really fully used, and is usually largely wasted space when the family vehicles are in use or are parked outside the garage. Garages of this type typically are shaped to define sheltered spacing approximating a box configuration that includes the front of the garage and the overhead door that is to open and close the doorway defined by same, side walls that define the depth of the garage as well as its width in terms of spacing crosswise of same, a garage end wall at the inner end of the garage, the floor, which is commonly a cement slab, and a ceiling, if the garage is at all finished off over the garage floor (otherwise the garage roof completes the sheltered spacing). The common overhead garage door is made up of hinged or pivoted panel sections formed from wood or the like that have their ends roll guided in tracks located at the ends of the door sections, and to either side of the garage doorway, which tracks have the familiar vertical or upright portions that smoothly curve into horizontal overhead portions for guiding the overhead door between its vertically disposed doorway closing position and its largely or wholly horizontally disposed overhead open position. One or more individual or person access and egress openings defining doorways, including the usual vertically swinging hinged door therefor, are commonly provided for access by individuals into and egress from the space sheltered by the garage, usually in one of the vertical walls of the garage, in addition to the common overhead door arrangement that is to open and close the garage for vehicle entrance to and egress from the garage.

It has also developed in recent years that a basic essential for insuring family togetherness as the family children grow through childhood and maturity is that the family members start at an early age of the children to engage in recreation that includes all of the family members, that provides a way for all the family members to have fun together (and at times with neighbors and friends), that answers the need to supplement the recreation and sport activities that the family children engage in at school, but at home, free of undesirable influences away from the home, and that provides a way for parents to engage in the regular exercise they need to continue in good health, without having to join athletic, health, or sporting clubs that take them away from the home just for this purpose.

With the foregoing in mind, the Applicant has observed that the garage of the typical family home and its equivalent in rental or condominium facilities, which is primarily intended to provide sheltered parking space for the family vehicle or vehicles, commonly has room enough in same to accommodate the provision of a family recreation center, so that, when the family vehicles are not in the garage, the otherwise unutilized space in the garage can be used to permit family member involvement (and perhaps including friends and neighbors) in recreational activities that are also sheltered, and that can be concerned with playing, depending upon the space available, one of the numerous types of sport ball games, played by hand or with racquets, or adaptations of same, and other exercise oriented activities, that are commonly now found at athletic clubs, health clubs and spas and the like, but which family oriented activities can take place right in the family garage instead of having to leave the home owner's property for these purposes.

Accordingly, a principal object of the present invention is to provide a panel partitioning arrangement for application to and within the conventional home garage that provides a recreation chamber defined by flushed surface vertical walls forming playing surfaces of up to the number that will give the common box or parallelepiped configuration, which chamber is located just inside of and may include the garage door as defining part of same, which arrangement accommodates ready parking or positioning of the family vehicles, tools, and other equipment within the confines of the garage when the use of the garage sheltered space is desired for this purpose, or alternately, when the family vehicles are absent from the garage, and the garage door is closed, the panel partition arrangement involved forms a family recreation or sports center in the form of a chamber that is defined by the garage floor and the supplemental vertical walls that are provided in accordance with the invention, which may be arranged in box configuration and shaped and mounted to define on the respective interior surfaces of the chamber, playing surfaces to accommodate the playing of ball games such as hand ball, squash, badminton, racquetball, or the like, depending on the space available in a particular garage, or accommodate the use of individual pieces of exercise equipment, such as those of the bicycle, treadmill, or jump rope type, bar bells, or just playing common games such as hopscotch. In this connection, the terms "home garage", or "home owner's garage", and their equivalents, as used hereinafter, mean also garages of rental or condominium domestic property.

Another principal object of the invention is to provide a panel partitioning arrangement for application to and within the conventional home garage that is flexible in design to accommodate variations in layout and shaping of the home owner's garage, that contemplates the provision of vertical or upright wall structures in the garage space in association with the garage door, with the latter also being modified in accordance with the invention, to provide permanently installed supplemental walls in the garage that may optionally accommodate storage of tools and other equipment, and/or being formed to devise access openings to the garage from, for instance, the home owner's house, or from outside the garage exterior of the house, and work spaces within the garage for work bench and power equipment location and use independent of the operative relation of the recreation chamber in question, which supplemental vertical walls may be arranged to alternately provide within the garage when the family vehicles are absent, the indicated recreation chamber that preferably approaches box or parallelepiped configurations suitable for family playing of ball games or the like, or just exercising, in foul as well as fair weather.

Still another principal object of the invention is to provide a panel partitioning arrangement for application to and within the conventional home garage involving supplemental vertical or upright wall structures positioned in the garage space in association with the garage door, which door is also modified in accordance with the invention, to define a flush inner surfacing when it is in closed relation, which supplemental wall structures optionally may be strictly panel partitioning, may be apertured and structured to define internal storage compartments and garage space access passways that are all provided with closures such that the side of the supplemental wall structure that is to define one side of the recreation chamber is flush surfaced for good ball playing characteristics, and with one or more of the supplemental wall structures involved being mounted to swing or shift between recreation chamber providing positions and other out of the way positions that accommodate normal use of the garage for car parking and equipment storage purposes.

Yet other objects of the invention are to provide a panel partitioning arrangement for application to and within the conventional home garage to optionally provide the recreation chamber contemplated by the present invention without any loss of the utility of the space defined by the garage, and yet permit normal vehicle parking use of the garage when that is preferred, to provide a panel partitioning arrangement of the type indicated that is reducable to kit form for supplying the home owner or other occupant with the means for providing the indicated recreation center in his garage, and to provide a panel partitioning arrangement of the type indicated that is inexpensive of manufacture and installation, that may be readily installed by the home owner or other occupant himself using simple hand tools, that when operatively positioned for recreation or sports center chamber defining use accommodates the playing by the family members (and their friends and neighbors as desired) of a wide variety of the common type sporting games, whether of the ball type or otherwise, and family member activity in connection therewith, or suitable exercise equipment use, or the like, as the space involved accommodates.

In accordance with the present invention, a panel partition arrangement is provided, for erection within the sheltered space defined by the typical garage, of supplemental vertical wall structures that with the garage door are adapted to define the indicated recreation chamber when recreation use of the garage is desired. The supplemental vertical upright wall structures are arranged in accordance with the positioning of the garage side walls, rear wall, and overhead door and the doorway it closes such that the vertical wall structures that form the side walls of the chamber will be coextensive with a predetermined length of the garage side walls that are disposed on either side of the garage overhead door and doorway it closes. The garage door sections are faced on their inner sides to be in flush relation in the closed position of the door and the supplemental vertical walls that are provided to form the side walls and end wall of the recreation chamber have their interior sides flushed surface to serve as ball playing surfaces, with the floor being obstruction free for defining the indicated recreation chamber. The vertical wall structures are optionally closeted or otherwise optionably openable for tool and equipment storage purposes, with the closure structures for the wall closeting or other aperturing being shaped for presenting the indicated flush surfacing for insuring the playing surfacing of the chamber in question as contemplated by the present invention. Further, one or more of the supplemental vertical walls are swingably or hingably mounted in place to swing horizontally or vertically between recreation defining chamber positions when family recreation play is desired, and out of the way positions when the garage space is to be used for family vehicle and tool parking or storage use.

Other objects, uses, or advantages will be obvious or become apparent from a consideration of the following detailed description and the application drawings.

In the drawings:

FIG. 1 is a block diagram illustrating the basic nature of the invention in which the outline of the interior of a typical home owner's garage is represented by the broken line showing, and in which is applied the panel partition structural arrangement contemplated by the present invention, indicated by the full line showing, which is for the purpose of providing within the space sheltered by the garage a recreation or sports chamber that preferably is of the indicated box or parallelepiped configuration suggested;

Figure 2:
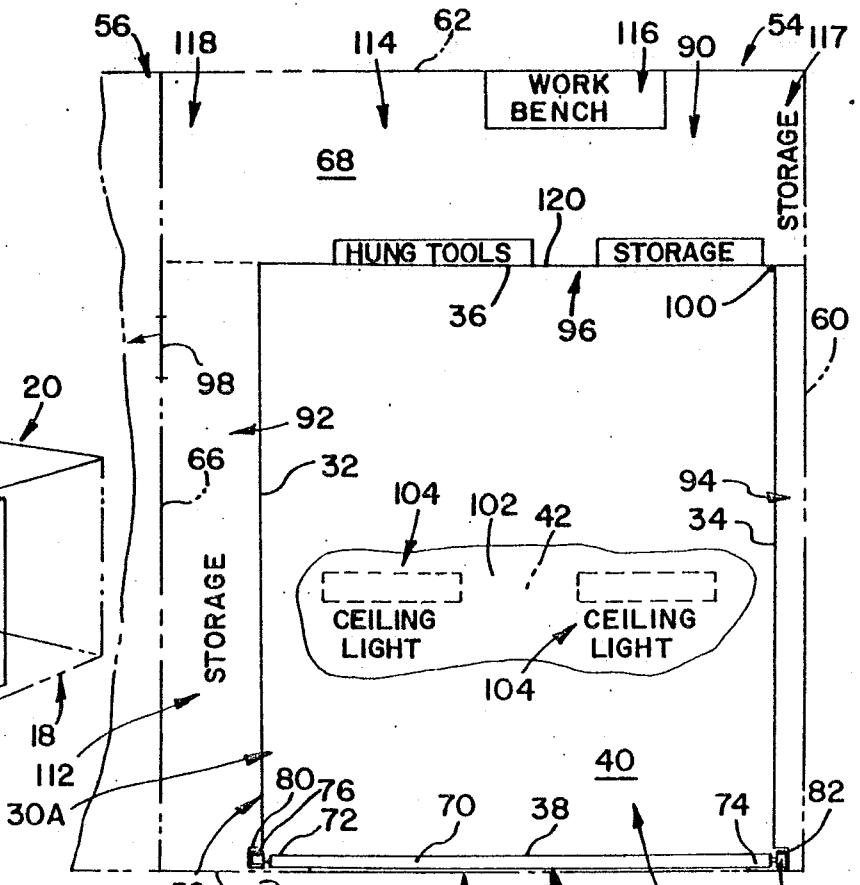
FIG. 2 is a diagrammatic plan view in largely block diagram form illustrating a particular application of the invention to a specific home garage arrangement, with the garage and adjacent home wall outlines being illustrated by the broken line showing and the recreation chamber being illustrated by the full line showing.
Figure 3:
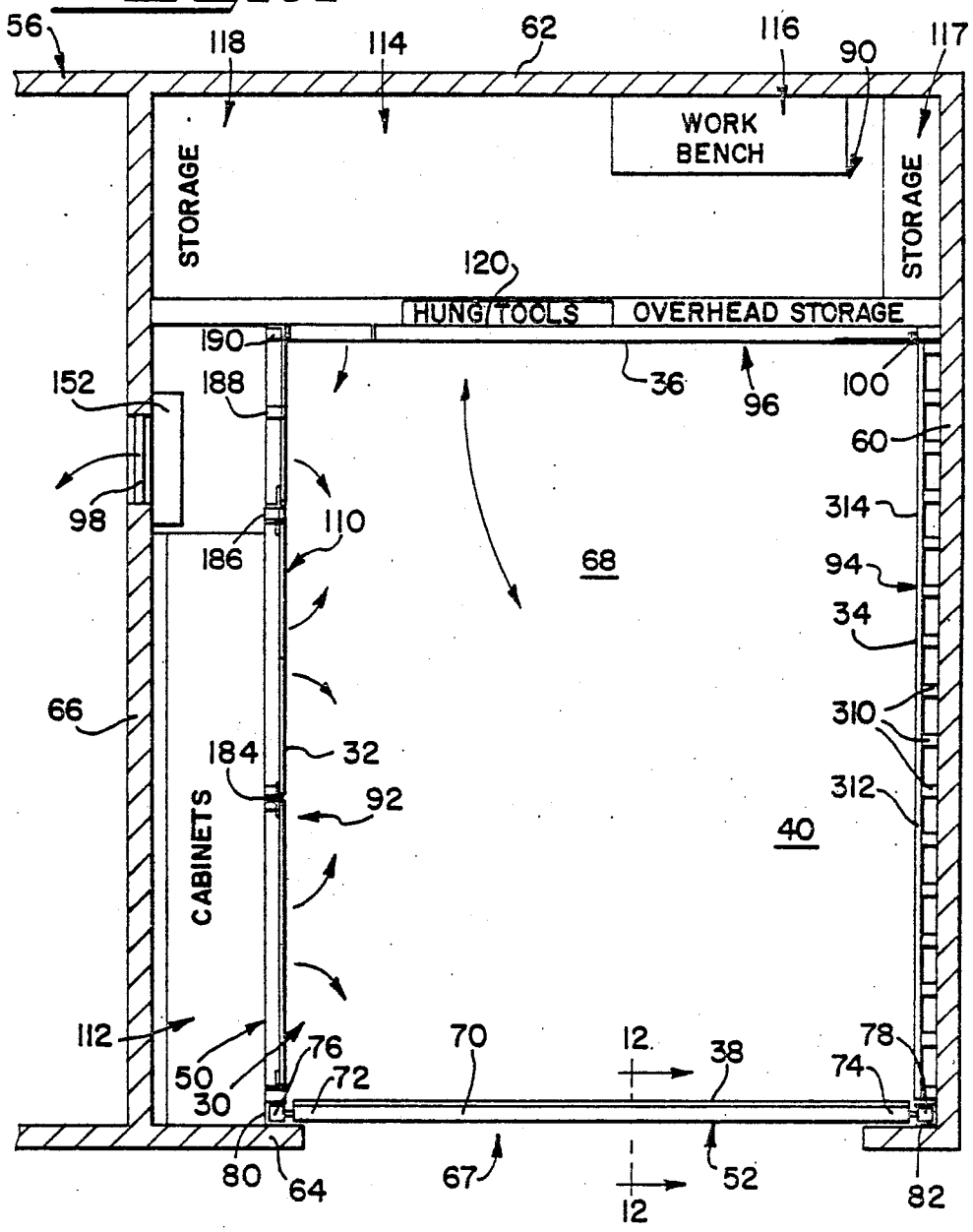
FIG. 3 is a plan view similar to that of FIG. 2, but in greater detail and more fully indicating the nature and location of the sports center or recreation chamber defining supplemental vertical walls with reference to the garage doorway defining wall, garage door, the garage walls, and the adjacent house, that are illustrated.
Figure 4:
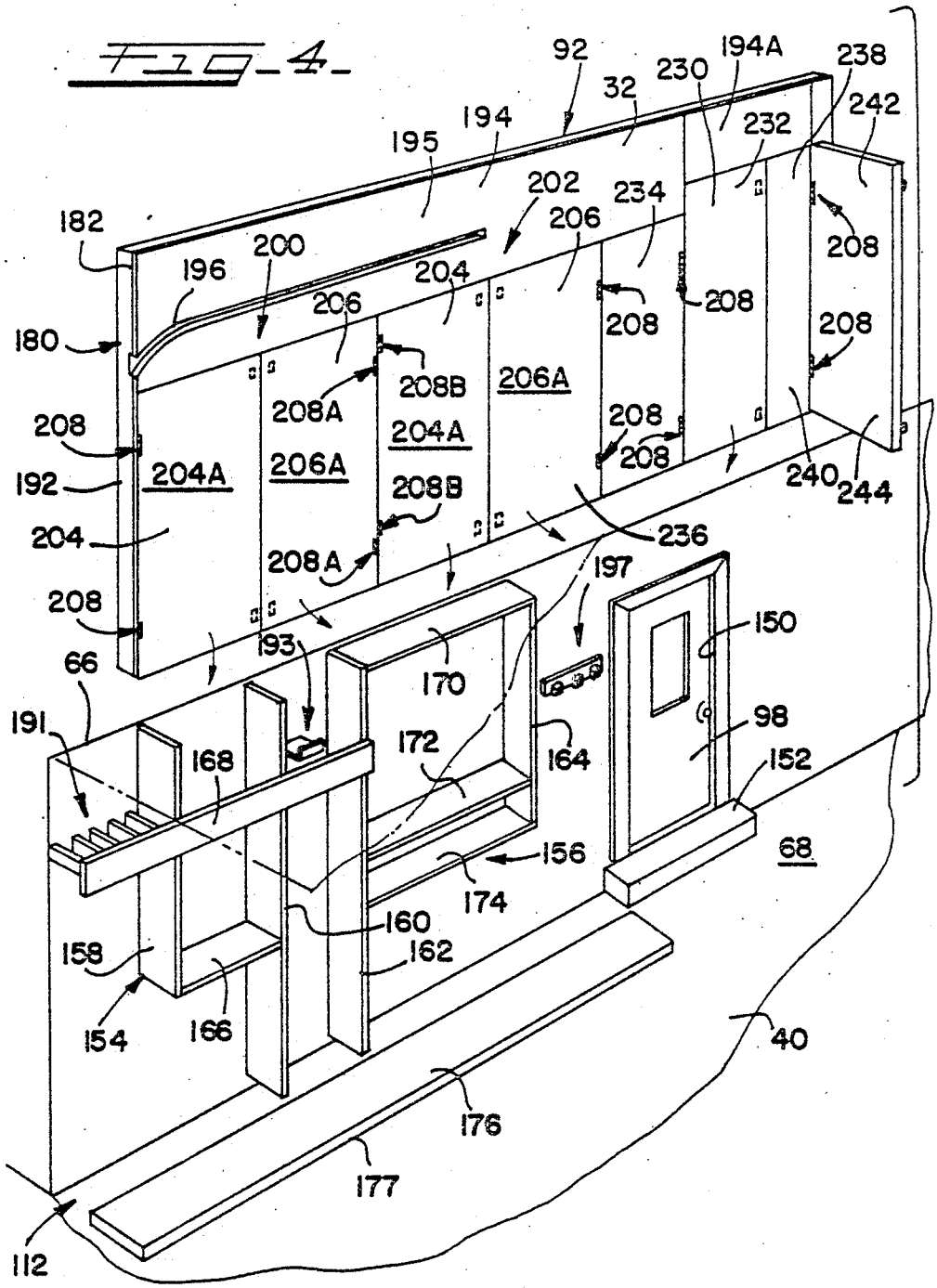
Figure 5:
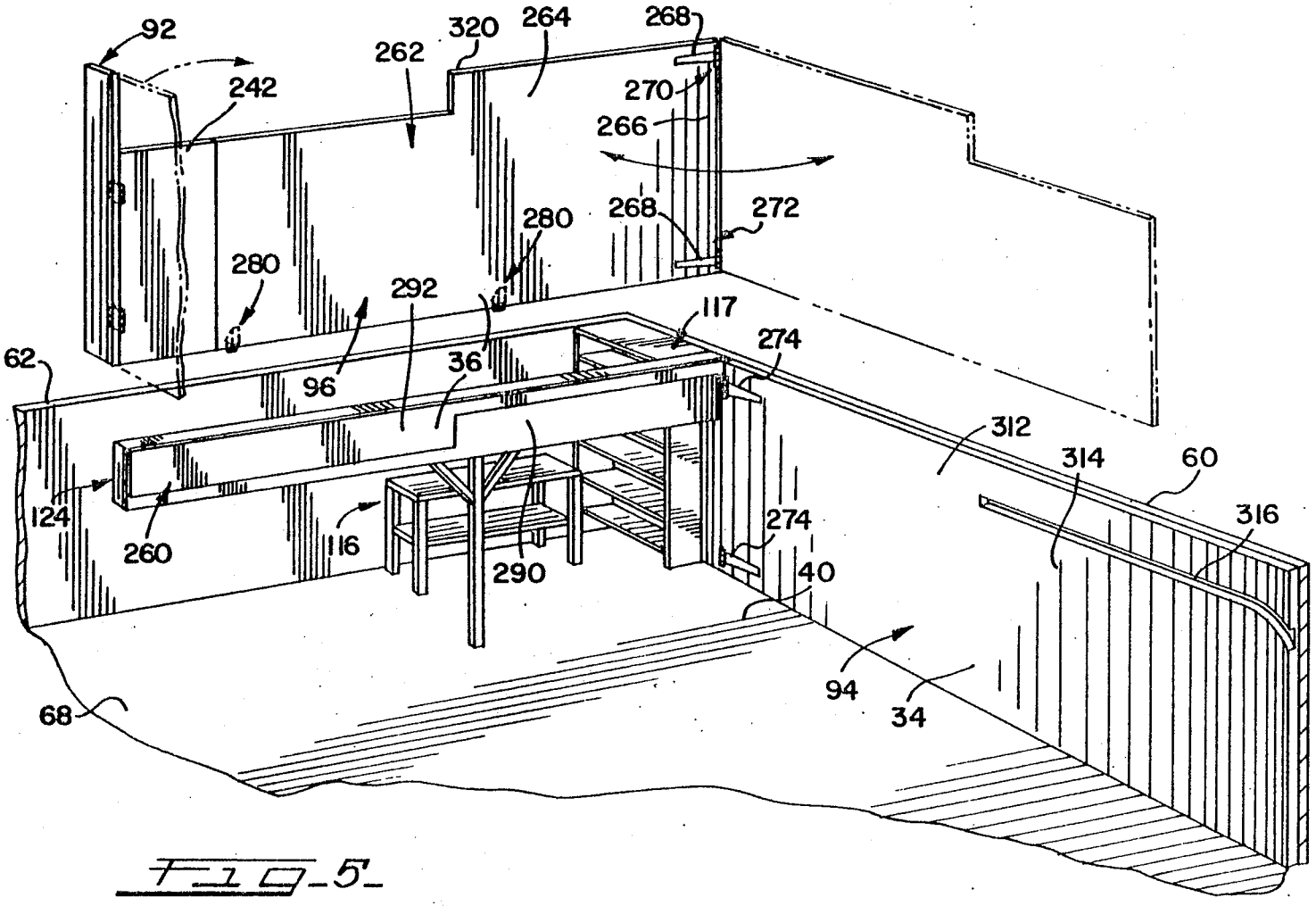
Figure 6:
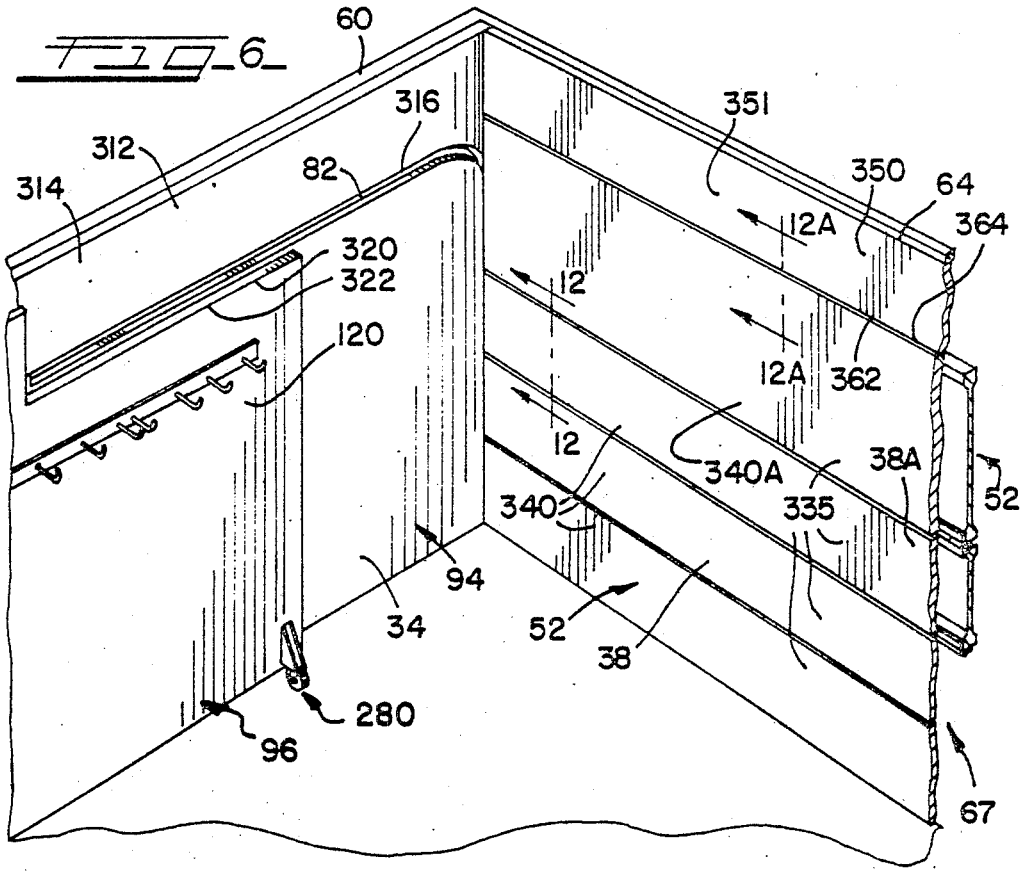
Figure 7:
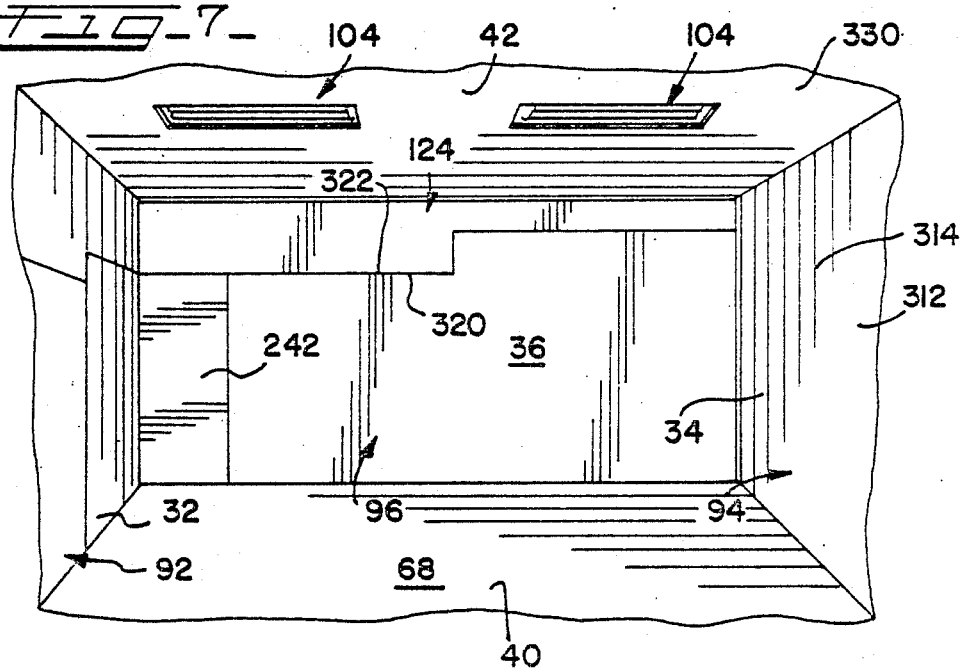
Figure 8:
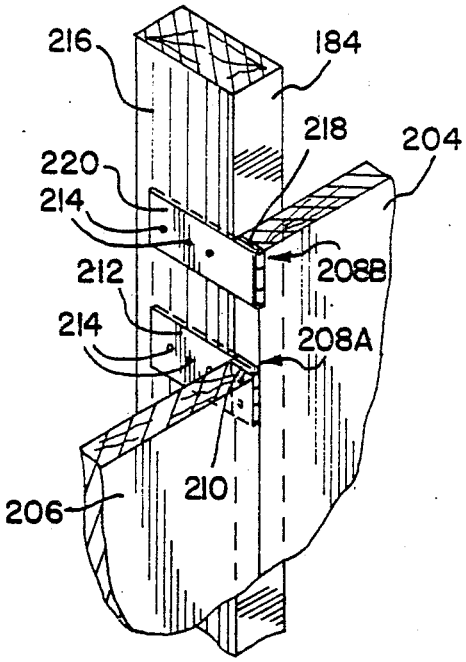
Figure 9:
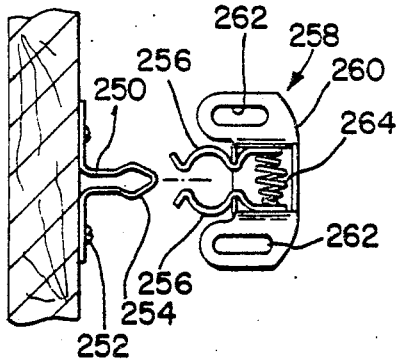
Figure 10:
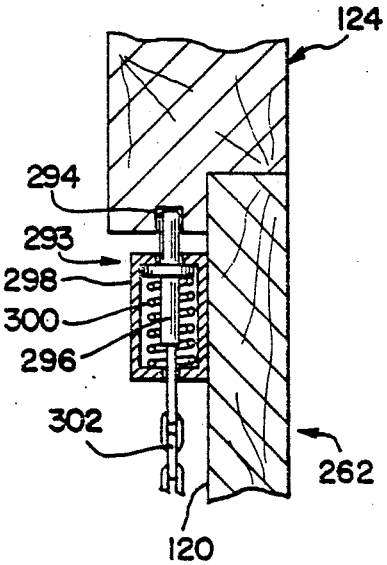
Figure 11:
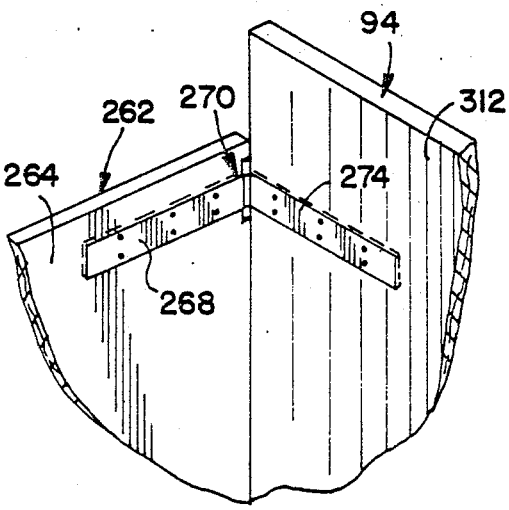
Figure 12:
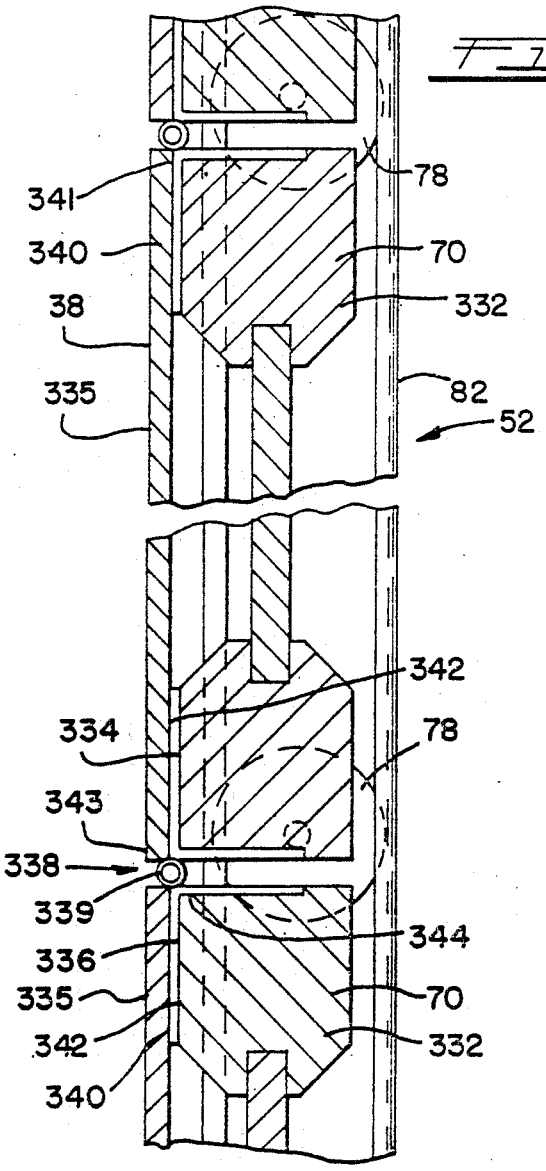
Figure 12A:
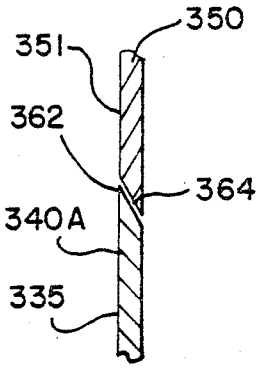
Figure 13:
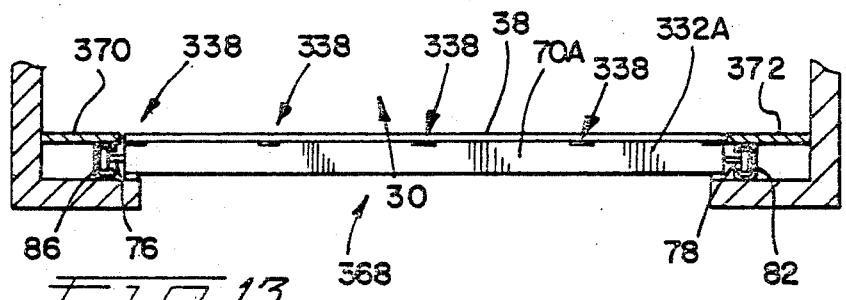

FIG. 4 is a fragmental diagrammatic exploded perspective view illustrating the left hand interior garage wall of FIG. 3 and the access doorway end therefor opening defined by same for entering the garage from the home owner's house, with the supplemental vertical wall panel partitioning for that side of the garage, as arranged in accordance with the present invention, being shown displaced vertically upwardly of its location of FIG. 3;

FIG. 5 is a diagrammatic exploded perspective view of the inner and right hand side of the garage shelter space shown in FIG. 2, with the supplemental vertical wall structure illustrated in FIG. 2 at this portion of the garage being displaced vertically upwardly to indicate its nature and alternate cooperations with adjacent structures involved;

FIG. 6 is a diagrammatic perspective fragmental view of the portion of the garage and supplemental vertical walls that define the right hand front corner of the garage arrangement of FIG. 2, illustrating the recreation chamber defining rear wall of the illustrated embodiments swung from its recreation chamber defining position of FIG. 5 to close adjacency with the supplemental vertical wall structure that lines the exterior wall of the garage, for exposure of the tool and equipment holding side of the swinging panel in question to the garage sheltered spacing when the garage is arranged for automobile parking and equipment storage purposes, and with the garage door being shown in its closed, recreation chamber defining position (with parts of same being shown broken away);

FIG. 7 is a diagrammatic perspective view of the garage arrangement of FIG. 2 looking from the garage door inwardly of the garage and showing the supplemental vertical wall structures involved arranged for recreation chamber defining positions, also indicating the preferred flush surfacing defining relation of the garage ceiling and lighting thereof for the recreation chamber in question;

FIG. 8 is a diagrammatic perspective fragmental view illustrating typical application of the hinging for the closet closure panels that are employed in connection with the closet and access door formations of the supplemental wall structure at the left hand side of the garage as shown in FIG. 2;

FIG. 9 illustrates a typical closure insuring catch for the closet and access doorway closures suggested in FIG. 4;

FIG. 10 illustrates a latching arrangement for the vertically hinged inner or rear supplemental wall structure that is illustrated in its recreation chamber defining positions of FIGS. 5 and 7;

FIG. 11 illustrates a typical hinge application for the swing panel arrangement of FIGS. 5 and 7;

FIG. 12 is a fragmental vertical sectional view taken substantially along line 12—12 of FIG. 12, but on an enlarged scale better illustrating the components involved in the particular door arrangement illustrated;

FIG. 12A is a fragmental vertical sectional view taken substantially along line 12A—12A of FIG. 6 illustrating a detail of construction; and FIG. 13 is a horizontal fragmental sectional view through the garage doorway and the overhead door therefor, illustrating a modified arrangement of the invention.

However, it is to be distinctly understood that the specific drawing illustrations provided are supplied primarily to comply with the requirements of the Patent Laws, and that the invention is susceptible of modifications and variations that will be obvious to those skilled in the art, and which are intended to be covered by the appended claims.

GENERAL DESCRIPTION

Figure 1:
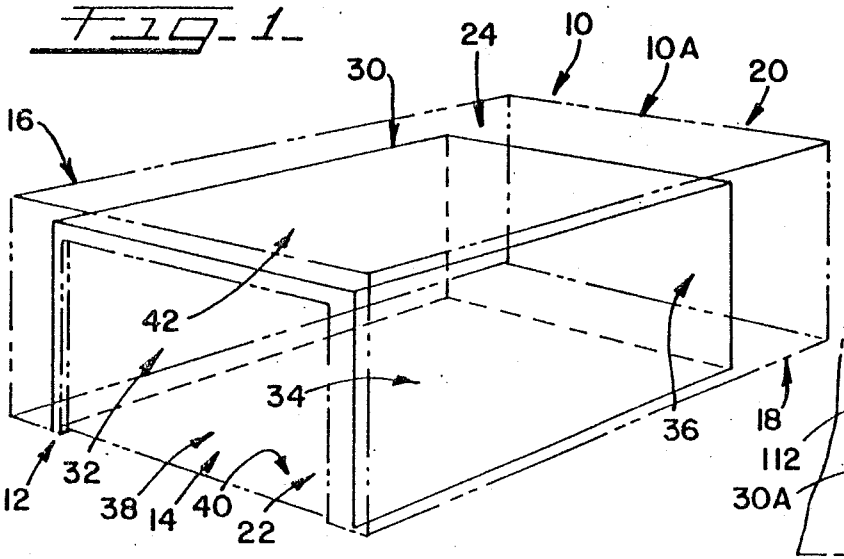

Referring first to FIG. 1, reference numeral 10 generally indicates the interior of the typical domestic garage that can be found associated with single family homes (attached or unattached), with the space 10 being indicated in broken lines that form the front wall 12 in which garage doorway 14 is commonly formed for entry into and egress from the garage space 10, side walls 16 and 18, and rear wall 20. The garage space 10 is also defined by floor 22, which is usually in the form of the common concrete slab on which home owner garages are commonly built, and ceiling 24, which may be of a suitable finished or semifinished type, depending on the building construction involved, or may be nonexistent as such, with the garage space being covered by one of the numerous forms of roof structures (not shown) that are commonly available to provide shelter for the space 10 from the elements so that the home owner may park his automobile in the garage 10A that defines the garage space 10 by driving the vehicle into the garage through its opening 14 in the usual manner. The doorway 14 is commonly provided with one of a numerous number of kinds of overhead door arrangements so that the door may be closed against the elements and opened to remove the vehicle as needed. The size of the garage 10A varies widely, but the garages today are commonly proportioned to accommodate two full sized automobiles in side by side relation, which is perhaps more typical of home owner garages available today, either with new housing or as constructed for the home owner, as distinguished from older garages which commonly were built to house a single family car. In common parlance, garages 10A, namely the space 10 thereof, is proportioned in accordance with whether the garage is a single car garage, a two car garage, a two and a half car garage, etc.

It is also a common practice for the home owner to store his yard equipment in the garage, or much of it, such as the family lawn mower, rakes, shovels, and other yard care tools, as well as sporting implements such as bicycles, mopeds and the like.

It is the Applicant's concept to provide in the garage 10A a family sports center in the form of recreation chamber 30 that is block diagram illustrated in FIG. 1, within the garage space 10, by the solid line optimal parallelepiped configuration, which chamber 30 is to include the front of the garage, so that the recreation chamber is open at the garage front end and is closed at the garage front end by the garage door when the garage door is in its closed position. The recreation chamber 30 is optimally, as indicated, of the parallelepiped or box configuration illustrated so as to define six essentially flush or flat playing surfaces of the type that are found in athletic clubrooms formed for the purpose of playing hand ball.

Thus, recreation chamber 30 optimally defines (see FIG. 2) opposed side surfaces 32 and 34, inner end surface 36, outer end surface 38 that is defined by the garage door's closed position, as hereinafter disclosed, floor surface 40, and ceiling surface 42.

As indicated, the chamber 30 starts at the threshold of the garage doorway 22, and the length, width and height of the chamber 30 will be limited by the desired space for chamber 30, as limited by the corresponding dimensions of the garage space 10 of the individual home owner's garage.

The basic aspect of the Applicant's invention is that the space 10 defined by the garage 10A, regardless of its specific dimensions and shape, is all too frequently wasted space of the home owner's home, especially when the home owner's vehicle or vehicles are for any reason outside of the garage 10A. A basic premise of this invention is that a recreation chamber 30 be provided within the garage space 10 that permits normal use of the garage as such without loss of any utility of the usual garage arrangement, but alternatively, when the home owner's vehicles are not in the garage or are moved out of the garage for any reason, the garage door may be closed and the side wall structures defining the recreation chamber 30 disposed, to provide the recreation chamber playing surfaces that are indicated to the extent that the home owner is able to complete vertical wall and other construction necessary to provide a chamber 30.

The Applicant has found that for the average two car garage, the vertical walls and other paneling features required to provide a chamber 30 are preferably arranged so that the chamber 30 approximates 20 feet wide, 20 feet long, and 10 feet high. However, the space defined by the chamber 30 as a practical matter may be of any room size dimensions that are consistent with the space available, although the basic shape involved optimally should be that of a parallelepiped or a quadrilateral box (which may be of square or rectangular configuration). For the basic essentials there must be at least one playing surface 32, 34, 36 or 38, plus the floor structure 40, defined by the chamber, with the playing surfaces so provided being flush thereacross and free from obstructions, protrusions, or anything that would substantially interfere with playing ball games and the like. It is preferable that the chamber 30 be defined by all six of the playing surfaces indicated for maximized benefits.

A further criteria of the invention is that where the garage is equipped with a common overhead door, the vertical roll guiding tracks that are disposed on either side of the door are preferably either recessed in the upright wall structures that define the surfaces 32 and 36, or they are covered by panel partitioning that is flush with the interior surfacing of the door is in its closed position. Overhead, the horizontal portions of the overhead door guiding tracks are recessed in the upright wall structures that define the surfaces 32 and 36, or they are recessed into or above the ceiling, which is suitably paneled to otherwise define playing surface 42. Further, all garage door opening door struts, hinges, and other hardware are flush or recessed mounted from the innersurface of the garage door, and each segment of the door has its own flush paneling so that when the door is in its vertical, doorway closing position, the flush paneling presents an inwardly facing surfacing that is substantially flush across the heighth and width of the closed door. The springs and door opener mechanism that may be part of any particular garage door arrangement should be hidden or recessed mounted to be outside of the chamber 30.

The structural arrangement of the vertical walls employed to define the chamber 30 is largely optional so long as the upright walls involved, when the chamber 30 is to be formed, are disposed to, or can be arranged to, define the desired substantially flush or planar playing surfaces that have been illustrated in FIG. 1. The vertical walls involved may be of fixed or movable construction, and if movable they are arranged to be swung out of the way when the garage space 10 is to be used in the usual garage manner, as for parking the home owner's vehicles. For these purposes the vertical walls may be arranged to be swung either about vertical or horizontal pivot axis. Where a vertical pivot axis arrangement is employed, it is preferable that the movable wall involved be swingable from a position in which one of its side surfaces defines a playing surface of the chamber and is flush contoured for this purpose, and the other side surface is arranged for application thereto of the various types of equipment the home owner has for yard work and the like, for storage purposes so that the wall has separate utilities in each position of use (one suggested form of this arrangement is disclosed hereinafter).

The sports center defining vertical wall structures involved may be compartmentized to define closets, drawers, and the like to store tools, equipment, supplies, etc. with the compartments having closures and the drawers having front ends that when closed are configured to be flush with the overall surface of the wall structure involved that is to define one of the playing surfaces of the compartment 30 when it is to be in use.

As indicated, the invention contemplates that the chamber 30 is arranged so that when the garage 10A is to be in normal use, the chamber 30 is in effect disposed in inoperative relation as such, and when the garage door is open the home owner's vehicles may be parked in the garage in the usual manner along with other equipment and tools as may be necessary or desirable. However, when it is desired that the recreation chamber 30 be brought into operative relation, this is done to define the playing surfaces that have been indicated, which involves closing the garage door and the other panel closures that may be defined by the upright walls involved, and positioning one or more of the walls so that the playing surface it defines is disposed in accordance with the showing of FIG. 1. It is contemplated that one of the upright walls involved will have an access doorway for admitting family members to the chamber 30, from the family home, which doorway will be closed by hinged paneling that closes flush with the flush surfacing of the basic upright wall structure involved, so that when all the family members who are to be involved in the athletic activity within the chamber 30 are present, which, of course, may include neighbors and friends as convenient or desirable, the access door may be closed and recreational sports or play proceed.

The interior of the chamber 30 may be suitably marked with indicia as needed so that the participants in the sports or play activity can engage in one of the familiar ball sport type games such as hand ball, squash, badminton, racketball, or the like, or adaptations of these activities, depending on the size of the chamber 30 that is available. Alternately, the use of individual pieces of exercise equipment, such as exercise bicycles, treadmills, or the like may be pursued, or perhaps exercise preceding, with simpler implements such as jumping rope or bar bells. Further, the floor surface 40 can be suitably marked to play games such as hopscotch, shuffle-board, indoor horseshoes, etc.

The chamber 30 preferably is arranged for optional lighting from the ceiling using recessed lights that are flush covered so as to avoid detraction from the flush surfacing defined by the desirable ceiling surface 42, and suitable heating means may be provided as desired to heat the chamber 30 during winter or other inclement weather as desired.

The disclosure that follows illustrates suggested arrangements of the type contemplated by the present invention, which are intended to indicate several specific ways in which the invention may be pursued. It is to be understood, however, that the specific illustrations provided should be considered examples only of specific ways to practice the invention and it should be kept in mind that the garage space available may require modifications and adaptations in the structure suggested, that will be apparent to those skilled in the art, to achieve the recreation chamber arrangement contemplated by the present invention.

SPECIFIC DESCRIPTION

FIG. 2 shows in largely block diagram form a plan view of one specific panel partition arrangement 50 for defining a sports center of recreation chamber 30A in association with overhead garage door 52 of a garage 54 that is attached to a family home 56. In the showing of FIG. 2, the garage and house walls are indicated by the broken lines to define garage exterior side wall 60, the garage rear wall 62, the garage front wall 64 that defines the usual doorway 67 at the front of the garage in which the overhead door 52 is operably mounted, the garage interior side wall 66 that in the attached garage arrangement illustrated is common with the corresponding side wall of the house 56, and the garage floor 68 which is assumed to be the usual poured concrete slab on which the garage 54 is erected, with the slab 68 thus being continuous across the spaced defined by the garage walls 60, 62, 64, 66 and the doorway 67. As is conventional, the overhead door 52 is composed of the usual sections 70 formed from wood or the like that are suitably articulated and at their ends 72 and 74 are provided with the respective sets of guide rollers 76 and 78 that respectively ride in the respective channel shaped tracks 80 and 82 to guide the door between its open and closed positions. The usual garage door torsion springs and openers that are a common part of garage doors of the overhead type are not illustrated as they may be entirely conventional.

In accordance with the invention, the space 90 of the garage 54 that corresponds to the space 10 of FIG. 1 is subdivided to provide the recreation chamber 30 by providing, in addition to the door 52, a compartmentized vertical wall structure 92 that parallels the garage interior side 66, a compartment free or straight vertical wall structure 94 that parallels and is closely adjacent to the garage exterior wall 60, and the movable vertical wall structure 96 that is disposed toward the inner end of the garage 54, and beyond the conventional door 98 that is suitably mounted in the garage wall 66 to provide access to the house 56, from inside the garage. The wall structure 96 of the arrangement diagrammatically illustrated in FIG. 2 is swiveled about vertical axis 100 between the full line position of FIG. 2 and close adjacency with the vertical wall structure 94.

In accordance with the invention, wall structure 92 is formed to define playing surface 32, wall structure 94 is formed to define playing surface 34, wall structure 96 is formed to define playing surface 36, and the garage door 52 is arranged to define playing surface 38 when the recreation chamber 30 of FIG. 2 is to be provided. The garage floor 68, which is normally flat in configuration, provides the playing surface 40, and in the optimal arrangement, the garage space 90 is fitted with a suitable ceiling structure 102 that extends between the vertical wall structures 32, 34 and 36 and is shaped to define playing surface 42. Ceiling 102 preferably is constructed to include one or more ceiling lights 104 that are preferably of a suitable conventional recessed type with transparent or translucent covers that are in flush relation with the ceiling surfacing that defines the play surface 42.

The recreation chamber 30 is thus defined by overall panel partition arrangement 50 which is arranged to provide storage within the wall structure 32 where indicated at 112, and a garage work area where indicated at 114 at the rear of the garage where the home owner may place his work bench 116 and associated mounting panels for storing tools used in connection with same, with other space being available where indicated at 117 and 118 for storage as needed.

A feature of the present invention is that the movable wall structure 96 on the side of same facing rearwardly of the garage, namely side 120, is equipped for fixed storage purposes, and for hanging tools vertically, such as rakes, ground working forks, hose, and the like. The fixed storage provided for by the wall structure 96 is preferably in a fixed header structure 124 at the ceiling level of the garage and accessible from the area 114 of the garage, while side 120 of the wall structure 96 is preferably part of the movable portion of same so that the hung tools, when wall structure 96 is positioned adjacent the wall structure 94, will be facing the wall structure 92 and thus readily available to the family members within the space that is normally occupied by the family vehicles. This positioning of the wall structure 96 exposes the garage area 114 to substantially full view from the front end of the garage.

A feature of the invention with regard to the wall structure 92 is that the surfacing of same that defines the playing surface 32 includes closure members corresponding in locations to the compartmenting thereof and access door 98, with suitable releasable locking or catch means being provided therefor for providing access to the storage area 112 and the door 98, from within the garage to the right of the playing surface 32. When the recreation chamber 30 is to be provided, all such closures are moved to their closed positions so that their surfacings with the remainder of the surfacings of the wall structure 92 define the substantially flush or flat playing surface 32.

As indicated, when the chamber 30 is to be formed or provided, the wall structure 96 is swung about its axis 100 to the full line position of FIG. 2, thus exposing the playing surfaces 34 and 36. In addition, the door 52 is moved to its closed relation, thus positioning the playing surface 38 in its desired upright position.

With this relation of the various wall structures and overhead door that have been described, family athletic or recreational activities may proceed within the chamber 30, with the specific activity involved depending on the game equipment and space available and the number of people to play. Hand ball type games are certainly most appropriate for equipment of this type, and various racket games may also be played assuming the requisite space and number of individual participants needed to safely provide active game play.

Alternately, treadmill or bicycle type exercise machines may be moved from the storage area 112 into the chamber 30, rope jumping can take place, or the like exercise activities can proceed. As already indicated, the surface 68 in the area of the chamber 30 may also be marked with suitable indicia for playing such games as hopscotch, shuffleboard, indoor horse shoes, and the like.

FIGS. 3–7 are diagrammatic illustrations of specific arrangements that may comprise the various components forming the recreation chamber 30 that is block diagram illustrated in FIG. 2.

In the showing of FIG. 3, reference numerals corresponding to those of FIG. 2 indicate like parts more specifically illustrated.

With reference to FIGS. 3 and 4, the vertical wall structure 92 is illustrated more specifically in a practical version of same, in association with the garage interior wall 66 and the access door 98 to the house 56, the latter at the threshold of the doorway 150 involved having a step 152 of any conventional character, such as a block of concrete, as may be needed because of the difference of elevation between the floor of the house adjacent access door 98 and the slab 68.

The vertical wall structure 92 thus comprises suitable framework assemblies 154 and 156 involving vertical planks 158, 160, 162, 164, and horizontal planks 166, 168, 170, 174, which may be formed from wood or the like, suitably fixed together into the garage interior wall 66 to define shelving and storage space within the storage area 112, with the vertical planks resting on horizontal base blank 176 that may rest directly on slab 68. Positioned along edge 177 of plank 176 is partition structure 180 that for wall structure 92 defines the play surface 32. The partition structure 180 may be of any suitable type to provide the function desired, such as vertical studs 182, 184, 186, 188 and 190 fixed together in any suitable manner to define framework 192 to which strips of paneling 194 and 194A are affixed in coplanar relation, with the framework 192 and its paneling 194 being suitably slotted as at 196 to receive the corresponding configured upper portion of the overhead door roller guideway 80 that is to be disposed at that side of the garage doorway 67. Partition structure 180 is suitably secured between the garage roof or ceiling and slab 68. In the area of framework assemblies 154 and 156, suitable devices may be applied where indicated at 191, 193, and 197 for holding or hanging upright tools with long handles.

Below the header panel strip 94, the partition 180 has applied to the same side of same two pairs 200, 202 of access doors 204 and 206, with each pair of doors 200, 204 comprising similar doors 204 and 206 hinged to adjacent studding where indicated at 208, to swing between the closed positions of FIG. 4, wherein the external surfacings 204A and 206A of the doors 204 and 206 is coplanar with the surfacing 195 of panel strip 194, to open positions whereby full access is available to the closeting and other compartments within the storage area 112 that is defined by the wall structure 92.

The hinging of the doors 204 and 206 may be in any suitable manner, though where a door 206 is hinged to the same stud as the door 204, the hinging relationship of FIG. 8 is preferred, wherein the door 206 is suitably affixed to a short leaf 210 of a hinge 208A, which has a longer leaf 212 that is suitably secured to the stud 184 as by employing suitable screws 214 or the like, and at one side surface 216 of the stud 184 involved. The door 204, on the other hand, is suitably anchored to a relatively short leaf 218 of hinge 208B, which has a relatively long leaf 220 that is affixed to the same side 216 of stud 184, as by employing suitable screws 214 or the like.

As indicated in FIG. 8, the hinges 108A and 108B are disposed at different levels horizontally, which may be reversed. The hinges 108 may comprise either a hinge 108A or a hinge 108B.

Below the header panel 194A closure door 230 is provided which is lined up with and substantially coextensive with the house access door 98 and its doorway 150, and is hinged in place by suitable hinges 208 secured to a stud 186 of partition structure 180 in a manner similar to that illustrated in FIG. 8, so that the door 230 swings from the closed position of FIG. 4, wherein its external surfacing 232 is in coplanar relation with the playing surface 32, to the open position in which it permits person access between the chamber 30 and the house 56.

Between the door 230 and the next adjacent closet door 206, a fixed panel 234 is mounted on the framework 192 to have its external surfacing 236 coplanar with and part of the playing surface 32. The hinges 208, 208A and 208B that are illustrated and referred to are all recess mounted as indicated in FIG. 8 so that the entire surfacing of the wall structure 92 is substantially flush coextensively therewith. Adjacent the door 230 is another fixed panel 238 that is suitably fixed to the framework 192 so that its external surfacing 240 is coplanar with the surface 32, and hinged to the framework 192 is closure door 242 that is suitably formed from paneling or the like to define exterior surfacing 244 that is of a planar character and when it is in its closed position, as indicated in FIGS. 3 and 7, the surfacing 244 is coplanar with playing surface 36 of wall structure 96. Closure door 242 is suitably hinged in place employing hinges 208 that are secured to the stud 190 in the manner suggested by FIG. 8.

The closure doors 204 and 206, 230 and 242 may be held in closed position by employing the conventional fastener device shown in FIG. 9, which involves the conventional stub type fitting 250 secured to the swing panel involved, by employing suitable screws 252, that defines a protubrant head 254 that is received between conventional spring arms 256 of the spring biased clip device 258 that is suitably anchored to adjacent studding or the like, which in addition to the gripping arms 256, clip 258 comprises bracket members 260 that are secured in place on the framework at the appropriate location, as by employing suitable screws in adjustment slots 262. Compression spring 264 operates on the spring arms 256 in a conventional manner to maintain their clamping hold on the stud 250 that is secured to the closure involved.

Referring now to FIGS. 5-7, the wall structure 96 is of two part construction, including fixed header structure 124 formed of suitable framing and paneling and affixed where indicated at 260 to the ceiling of the garage, and/or between the garage walls 60 and 66 in any suitable manner, so as to be in fixed position across the garage space at the location where the wall structure 96 is to be located in accordance with the invention.

Below the header structure 124 is swingably mounted panel partition 262 that is formed from suitable framing and paneling to define planar surfacing 264 that is coplanar with the playing surface 36. The panel partition 262 at the hinged end 266 of same has recess mounted in its surface 264 the leaves 268 of suitable hinges 270 and 272, which may be of the type suitable for hingedly mounting barn doors. The hinges 270 and 272 also include the respective hinge leafs 274 (see FIG. 11) that are recessed mounted in wall structure 94 with the arrangement being such that the hinges 270 and 272 are both aligned with the common vertical axis 100. The hinge leaves 268 are flush with the surfacing 264 of panel partition 262, while the hinge leaves 274 are flush mounted with regard to the playing surface 34 of wall structure 94. The panel partition 262 is equipped with one or more suitable roller devices 280 that include rollers journalled to rotate about a common axis that is horizontally disposed and coplanar with the panel partition 262, which rollers ride on the floor 68, so that the panel partition 262 can be swung about the hinge axis 100 from the full line position of FIG. 5 to the dashed line position of same, which position is illustrated in full lines in FIG. 6, wherein its playing surface 36 is in abutting or closely spaced relation to the playing surface 34 of the wall structure 94, and its opposed surface 120 faces the wall structure 94. Roller devices 280 are mounted so that their rollers are inwardly or rearwardly of surfacing 264 (see for instance FIG. 6).

When the panel partition 262 is in the full line position of FIGS. 5 and 7, it is to be in substantially conforming relation with the indentation 290 that is defined by the header 124, with the indentation 290 being such that the vertical surfacing 292 of the header 124, and the surfacing 264 of the panel partition 262, are in substantial coplanar relation, and are substantially coplanar related with the playing surface 36.

FIG. 10 illustrates a spring biased latch device 293 for latching the panel partition 262 in its position of FIGS. 3 and 7 in which the header structure 124 is formed with a bore 294 that receives a spring biased plunger 296 contained in suitable housing 298 that is suitably fixed to the side surfacing 120 of panel partition 260, with plunger 296 including compression type biasing spring 300 operating on same to hold the plunger in locking relation, and a pull chain or the like 302 being provided to release the plunger from the header recess 294 when desired. Latching device 293 is omitted from the diagrammatic showings of FIGS. 5 and 6.

The header 124 is also provided with a latching arrangement of the type indicated in FIG. 9 at the location of the door 242 to latch the door 242 in its position where its surfacing 244 will be coplanar with playing surface 36.

All closure doors illustrated in connection with the showing of the recreation chamber 30 are openable from inside chamber 30 by finger action on their free vertical edges as to pry apart the latches holding them closed that as already indicated, are of the type shown in FIG. 9.

The wall structure 94 is applied in fixed, face to face relation with the garage exterior wall 60, and may be of any suitable type that will define the playing surface 34, such as the illustrated studs 310 (not shown in diagrammatic FIGS. 5–7 and 11) suitably anchored in spaced apart coplanar relation to which paneling 312 is applied that is of substantially planar surfacing 314 so as to define and be coplanar with playing surface 34. The wall structure 94 is notched as at 316 to receive in recessed relation to the upper portion of the door roller guide 82 that is suitably operatively mounted therein. In the particular embodiment illustrated, the upper edging 320 of the swinging panel partition 262 is indented as at 322 so as to be disposed somewhat below and be coextensive with the portion of the header indentation 290 the panel partition 262 overlaps when the panel partition 262 is in its position of FIG. 6 (as indicated in FIG. 6) when the panel partition 262 is disposed in its broken line position of FIG. 5 (see FIG. 6), it is disposed; so as to expose its hung tools and the like for ready access by the home owner from the portion of the garage in which the home owner's vehicles are to be parked when in the garage (see FIG. 6).

The indentation or recess 290 of the header 124 is correspondingly configured so as to provide a complimentary fit of the upper edging 320 of the panel partition 262 in the indentation 20 (see FIGS. 5 and 7).

With regard to the garage ceiling that defines the playing surface 42, this may be of any suitable type defined by appropriate paneling 330 suitably affixed to the garage structural framing in any convenient manner, so as to dispose the surface 42 substantially parallel with the floor surface 40 in parallelepiped fashion. As already indicated, the overhead lighting lamps 104 may be of any suitable recessed type.

Referring now more specifically to FIGS. 6 and 12 with regard to the overhead door that is there illustrated, the front wall 64 is appropriately formed to define the usual garage doorway 67 across which the garage door 52 is mounted. The door 52 is operably mounted across and just inside of same and in the form illustrated comprises a plurality of the sections 70 in the form of elongate rectangular panels 332 that may be formed from wood or the like and that are articulated together in side by side relation so that the garage door may be rolled from its doorway closing, vertically disposed relation, to an overhead, substantially horizontally disposed, door open position, as is customary for overhead rolling garage doors.

The garage door 52 illustrated, for adjacent panels 332, has a special hinging arrangement which comprises between each adjacent pair of panels 332, an upper strut member 334 to which an upper panel 332 is secured, as by employing suitable screws or the like (not shown) and a lower strut 336, to which the adjacent lower panel 332 of the hinged set of panels is secured (again by employing suitable screws or the like). The struts 334 and 336 for each set of articulated panels 332 extend the width of the door, and at spaced positions they are hinged together as at 338. The strut members 334 and 336 are of right angled configuration, and the hinging together of same may be effected at the hinge points 338 by alternately fixing, by welding or brazing, or screw fastening, metal loops or knuckles at such locations, which are operatively hinged together by suitable hinge pins 339.

Each panel 332 on the inside surfacing of same has affixed thereto a sheet 340 of hardboard or the like, with the arrangement being such that the hinge axis of the respective hinges 338 is in coplanar relation with the hardboard sheets 340 when the door is in its down or closed position, and the horizontal edges 341 and 343 of the respective sheets 340 are in closely spaced relation to the hinges 338 that are suitably recessed in place, as indicated in FIG. 12. The sheets 340 are applied to the respective panels 332 so that when the door is disposed in its closed relation, their inwardly facing surfaces 335 are in coplanar relation and are coplanar with the playing surface 38 they are to define. The struts 334 and 336 are each of right angled configuration, as indicated, and thus each define the flange portions 334 and 336 that are respectively vertically horizontally disposed when the door is in its closed relation.

Each door panel 332 is equipped at either end of same with the respective rollers 76 and 78 that are coaxially aligned adjacent like ends of the respective panels 22 (for instance the lower edges of such panels when the door is in its lowered relation), with the axial centers of the respective sets of rollers being also located adjacent the middle portion of the respective panels 332 (see FIG. 12). The respective rollers 76 and 78 ride in the respective tracks 80 and 82 which are suitably mounted to either side of the doorway 67, with the upwardly curved portions and the horizontally disposed portions of same being suitably received and anchored in the respective slots 196 and 316 of the respective wall structures 92 and 94. The respective hardboard sheets 340 at their ends extend in close proximity to the respective guides 80 and 82 so as to define with the paneling surfacings that form the respective playing surfaces 32 and 34 substantially right angled corners for good play surface relation between the two at each corner.

In the garage front wall arrangement that is illustrated the front wall 64 includes header structure 350 that spans the doorway 67 and defines planar surfacing 351 that is coplanar with playing surface 38. The sheet 340A of the uppermost door panel 332 is of somewhat extended width i.e., in the vertical dimension as shown in FIG. 6 so as to dispose its surfacing 335 above the upper level of the door in its lowered position, and preferably in coplanar relation with the inner surfacing 351 of the header 350 so that the playing surface portion 38A defined by the door in its closed relation extends upwardly substantially the height of the chamber 30 and is coplanar with surfacing 351. The upper edge 362 of the upper sheet 340A and the lower edge 364 of the header are complimentarily shaped so that when the door 52 is to be moved upwardly the sheets 40A is cammed somewhat inwardly and is free to move upwardly of the header 350 and thence toward its horizontal position in substantial alignment with the slots 196 and 316 at their horizontal portions in the open relation of the door (see FIG. 12A). Where the door 52 is operated using a conventional door opener, the operating mechanism for same is suitably hidden within the garage and located convenient for motorized operation. Where the door 52 is to be operated manually, it is preferable that the latch and handle arrangement therefor be suitably flush mounted within the door from the inside of same.

In the embodiment of FIGS. 3–7, the panels 332 of the door 52 and their corresponding hardboard sheets 340 and 340A are proportioned to extend between the roller guides 80 and 82 thereof (as indicated in FIG. 3).

In the alternate garage door 368 arrangement of FIG. 13, the door panels 332A (forming door sections 70A) are conventionally proportioned lengthwise thereof, and the guides 80 and 82 are located in the usual manner with regard to the sides of the door opening 67, and a pair of false walls 370 and 372 that extend the full length of the garage are suitably mounted at each side of the door 52. The false wall 370 may be in the form of a sheet of paneling suitably anchored to and extending between the guide 80 and the wall structure 92, while the false wall 372 may comprise a sheet of paneling suitably mounted between and connected to the guide 82 and wall structure 94. The door arrangement 368 as illustrated presupposes that guides 80 and 82 and the ceiling paneling 330 are arranged so that the ceiling defines a slot (not shown) through which the guides 80 and 82 are directed so that their horizontal portions are disposed above paneling 330, with the door 368 thus passing up through such slot to be hidden by paneling 330 when the door 368 is moved to its open position.

As an alternate to the embodiment of FIG. 13, door panels 332A have the guide rollers 76 and 78 applied thereto for suspending the door below the ceiling in the door open position, as by such guide rollers being respectively applied to individual support arms or brackets that extend outwardly of the garage doorway, when the door is in its closed position, an amount such that when the door is in its raised position the door will be disposed just below the ceiling paneling 330. In this alternate arrangement the aforementioned slot for the door itself is not necessary in paneling 330, but slots corresponding to the location of the horizontal positions of the track guides 80 and 82 are necessary to accommodate the hanging position of the guide roller support arms through ceiling paneling 330 in the open position of the garage door.

The basic idea in connection with the doors 52 and 368 is that when the garage door is in its closed relation, the playing surface 38 then completed thereby is defined by the coplanar relationship of the inwardly facing surfacings 335 of the respective sheets 340 and 340A, and as the door is raised to its overhead position, the articulated components of same tend to keep this relationship until they consecutively ride into and over the upwardly curved portions of the roller guides involved and thence into the horizontally disposed portions of the same to dispose the overhead door sections in the usual position of overhead doors moved to the open position.

It will therefore be seen that the invention provides a way for the home owner to make alternate use of the living space represented by the confines of the garage of his home, in such a manner that there is no loss of utility of the garage as such. When a garage is to be used as such, the vertical wall structures and associated parts that define the means whereby the recreation chamber 30 may be provided are disposed to accommodate the parking of automobile vehicles and the like within the garage and have access to tools and other equipment for yard work or the like. However, when it is desired to arrange the garage space for recreation use, the vertical wall structures 92, 94 and 96 and the garage door 52 (or 368) may be disposed to define the indicated recreation chamber 30 whereby the chamber 30 in effect forms a family sports center within the family garage in which many of the various types of ball type sporting games may be played, or space may be provided for exercising using exercise implements suitable for that purpose that are not concerned with ball games. When the garage space is needed for parking for storage purposes of the family vehicles, the vertical wall structures involved may readily be changed over to that alternate purpose.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

I claim:

1. In a family garage that forms a generally quadrilateral housing for one or more parked automobiles, which housing includes a vertical front wall defining the garage door opening, a sectionalized overhead door movably mounted to optionally close the doorway when in its lower vertically disposed position and optionally effect opening of the doorway for access into the garage through such doorway when moved to an overhead position within the housing, a vertical rear wall opposing the vertical front wall, and opposed vertical side walls extending between the front and rear walls to either side of the door opening, a generally flat floor, and a roof overlying the floor and sheltering the garage space defined by said walls, the improvement comprising:

a panel partition arrangement for defining a recreation chamber within the garage housing including a first vertical wall structure paralleling and substantially coextensive with a predetermined length of one of the garage side walls, said partition arrangement first wall structure being mounted in place and defining flush wall surfacing along the interior of said chamber on one side thereof forming a first playing surfacing of said chamber, said door comprising a plurality of panels articulated together in side by side relation and shiftably mounted adjacent their ends for said optional movement between the doorway closed position and the doorway open position, said door panels each having affixed thereto a continuous facing sheet of quardrilateral configuration having a facing surface facing inwardly of the garage, with said facing sheets being proportioned lengthwise and widthwise thereof such that in the doorway closing position of the door, said facing surfaces thereof are disposed in flush coplanar relation across the width of the door and are closely spaced vertically for forming a second playing surfacing of said chamber within said chamber, said partition arrangement including a second vertical wall structure mounted in place opposing said first vertical wall structure and coextensive therewith and defining flush wall surfacing along the interior of said chamber on the other side of said chamber and forming a third playing surfacing of said chamber that opposes said first playing surfacing, said vertical wall structures being side wall structures disposed on either side of the garage space that respectively parallel and are substantially coextensive with the respective side walls of the garage that are adjacent the overhead door, with the floor for said predetermined length of said one garage sidewall being obstruction free for defining a fourth playing surfacing of said chamber, said partition arrangement further including a generally flat and vertical rear wall structure comprising a framework hinged in place to swing about a vertical axis between a first position in which it extends substantially normally of and between said first and second vertical wall structures, and a second position in which it substantially abuts one of said first and second vertical wall structures, in overlying relation to said playing surfacing thereof, said rear wall structure including latch means for securing said framework in said first position, said rear wall structure framework including flush wall surfacing on one side thereof for comprising the interior of said chamber in said first position thereof and forming a fifth playing surfacing thereof, said rear wall structure framework including storage means including means for removably mounting tools on the other side of same for exposure to the garage doorway when said rear wall structure framework is in said second position thereof, said vertical axis being adjacent said one of said side wall structures, and is at one end of said hinged framework, whereby, when the garage is to serve as such, said rear wall structure is moved about said axis to said second position thereof to expose said other side thereof in the garage space along said second vertical wall structure and mask said third and fifth playing surfacings, and the door is disposed in its overhead position for automobile access into the garage through the garage doorway and is disposed in its lower position for enclosing the automobile therein, and when the garage is to provide said recreation chamber within the garage when the garage is automobile free, said rear wall structure is moved about said axis to said first position to partially complete said recreation chamber and expose within same both said third and fifth playing surfacings, and the door is disposed in its lower vertically disposed position to complete the perimeter of said chamber and to form said second playing surfacing within said chamber.

2. The improvement set forth in claim 1 wherein:

said rear wall structure further includes a stationary header structure that is formed and positioned to receive said hinged framwork in complementary fitting relation when said hinged framework is in said first position thereof.

3. The improvement set forth in claim 1 wherein:

the outer end of said hinged framework is roller mounted on the floor.

4. The improvement set forth in claim 1 including:

a ceiling structure mounted in horizontal relation above and coextensive with said floor playing surfacing and being shaped to form a flush ceiling surfacing thereacross that forms the ceiling playing surfacing of said chamber.

5. The improvement set forth in claim 1 wherein:

said first vertical wall structure is formed to define a plurality of closet and storage spaces and closure means therefor shiftably mounted in said first vertical wall structure and shaped to form said flush wall surfacing thereof coextensive therewith, said closure means including catch means for releasably holding said closure means in closed relation to define said first playing surfacing of said chamber.

6. The improvement set forth in claim 4 wherein:

said ceiling structure includes recess mounted lamp means for illuminating said chamber.

7. The improvement set forth in claim 1 wherein:

the one of the side walls of the garage includes an access doorway and door therefor for person entry into and egress from the garage, said first vertical wall structure defining further closure means shiftably mounted therein and substantially coextensive with the one garage side wall doorway, said further closure means including catch means for releasably holding said further closure means in closed relation, and being shaped to form part of said first vertical wall structure flush wall playing surfacing coextensively therewith.

* * * * *